United States Patent [19]

Kohyama et al.

[11] Patent Number: 4,647,181

[45] Date of Patent: Mar. 3, 1987

[54] ELECTROPHOTOGRAPHIC METHOD AND APPARATUS USING ALTERNATING CURRENT CORONA CHARGING

[75] Inventors: Mitsuaki Kohyama; Haruhiko Ishida, both of Tokyo; Toshihiro Kasai, Yokohama; Shigenobu Osawa, Kawasaki, all of Japan

[73] Assignee: Tokyo Shibaura Denki Kabushiki Kaisha, Kawasaki, Japan

[21] Appl. No.: 565,004

[22] Filed: Dec. 23, 1983

[30] Foreign Application Priority Data

Dec. 28, 1982 [JP] Japan ..... 57-233406
Dec. 28, 1982 [JP] Japan ..... 57-233407

[51] Int. Cl.[4] ..... G03G 15/00

[52] U.S. Cl. ..... 355/4; 355/3 CH; 430/42

[58] Field of Search ..... 355/3 R, 3 CH, 4; 430/42, 902; 361/225, 229, 235; 250/325, 326

[56] References Cited

U.S. PATENT DOCUMENTS 3,076,092 1/1963 Mott .
3,687,661 8/1972 Sato et al. ..... 430/902 X
3,848,989 11/1974 Yamaji et al. ..... 355/4
3,928,037 12/1975 Anzai ..... 430/42
3,984,182 10/1976 Gundlach et al. ..... 250/326 X
4,033,688 7/1977 Orthmann ..... 355/4
4,068,938 1/1978 Robertson ..... 355/4
4,245,272 1/1981 Rushing et al. ..... 361/229
4,353,970 10/1982 Dryczynski et al. ..... 355/3 CH X

OTHER PUBLICATIONS

*Xerox Disclosure Journal,* vol. 5, No. 3, May/Jun. 1980, pp. 269–271, Ruckdeschel et al, "Color Copier".
*Research Disclosure,* Jun. 1979, No. 18272, "Color Copier".

*Primary Examiner*—A. T. Grimley
*Assistant Examiner*—J. Pendegrass
*Attorney, Agent, or Firm*—Cushman, Darby & Cushman

[57] ABSTRACT

An electrophotographic method according to the present invention forms a color image on a photosensitive drum by repeating a cycle of charging, exposure and development for a plurality of times. The electrophotographic method comprises a step of applying a corona discharge component superposed with an AC voltage shifted to the negative or positive polarity which corresponds to that of the photosensitive drum to the photosensitive drum prior to the second image exposure so as to recharge the photosensitive drum.

15 Claims, 13 Drawing Figures

ELECTROPHOTOGRAPHIC METHOD AND APPARATUS USING ALTERNATING CURRENT CORONA CHARGING

BACKGROUND OF THE INVENTION

The present invention relates to an electrophotographic method and apparatus for forming a color image on an image carrier such as a photosensitive body and, more particularly, to an electrophotographic method and apparatus for forming a color image by repeating a cycle of charging, exposure and development for a plurality of times.

Color recording using an electrophotographic technique has a long history, and various techniques have been proposed. Among them all, the most significant techniques which receive attention these days include a technique in which a light-emitting element such as a laser beam or an LED array is used to form an image on a photosensitive body, and a technique in which an optical system is used to write optical information digitized by a liquid crystal or an optical switching element utilizing the Faraday effect.

Why these techniques are the most significant for the color recording are following reasons. First, copy densities of individual color components conventionally are not reproduced faithfully due to a noncoincidence between spectral light intensity distributions of the individual color components which are caused by color separation of the original image and a nonuniform spectral sensitivity distribution of the photosensitive body. Conventionally, in order to resolve this problem of color reproducibility, the processing speed is determined in accordance with the lowest spectral sensitivity of the photosensitive body. However, this restriction can be eliminated by using the above-mentioned color recording techniques. Second, an S/N ratio can be improved since the optical signal is processed by an electronic circuit. Third, various applications such as electronic image processing (e.g., image information editing) are made possible upon incorporation of a computer.

In an electrophotographic apparatus using a method for writing digitized image data on a photosensitive body, reverse development is performed to visualize as a toner image that portion of the photosensitive body which is exposed by light beams. The reverse development method can decrease a load of a digital processing circuit and a optical scanning system with respect to scanning precision.

Basically, an image according to color electrophotography can be formed by repeating a cycle of charging, exposure and development for a plurality of times which are identical with number of colors of the image. The electrophotographic apparatuses are divided into two types: one type wherein chargers, exposure units and developing units are each disposed in a number corresponding to the total number of colors of the reproduced image to perform the cycle of charging, exposure and developing for each color upon one revolution of the photosensitive body; and another type wherein only developing units are disposed in a number corresponding to the total number of colors of the image and a single charger and a single exposure unit are also disposed around the photosensitive body such that charging and exposure for each color is completed upon rotations of the photosensitive body. The former system has a large construction, but provides a short recording time. Thus, this system is promising from the viewpoint of practical applications.

The most preferable and advanced arrangement of the multicolor recording apparatus as described above is basically illustrated in FIG. 1. This apparatus will be described with reference to FIGS. 1 and 2.

An original placed on an original table 1 is exposed by a known exposure optical system 2, and light reflected by the original is separated by a known tricolor separation filter 3. Separated light is incident on an image reading element 4 of a photoelectric transducer type which comprises a charge-coupled device (CCD) array called a solid-state imaging device or image scanner, or a photosensitive (e.g., silicon) array. Thus, three color components can be converted to corresponding electrical signals. These electrical signals are supplied to a memory/data processor 5. Thereafter, the signals are supplied through an output circuit 6 to optical image scanning units 9, 10 and 11, each of which comprises a laser beam array, a light-emitting diode (LED) array or a liquid crystal shutter array. An electrophotographic photosensitive body 8 as an image carrier charged by a charger 7 to a predetermined potential V1 is exposed using the optical image scanning units 9, 10 and 11. In this scanning/exposure operation, three optical outputs (red, blue and yellow in this embodiment since the tricolor separation filter is used) obtained in accordance with the color components separated by the tricolor separation filter 3 are scanned with beams 9*a*, 10*a* and 11*a*, respectively. Developing bias voltage VB higher than a potential VR1 of the exposure portion is applied to electrophotographic developing units 12, 13 and 14, respectively corresponding to the colors of the exposure light beams, so as to perform reverse development and hence form a multicolor image having three colors. The color image formed on the photosensitive body 8 is transferred by a transfer corona discharger 16 to a recording paper sheet P supplied from a paper supply unit 15. Thereafter, the paper sheet P thus transferred is separated by a separating unit 17 from the photosensitive body 8. The image formed on the paper sheet P is fixed by heat of a fixing unit 18, and the paper sheet is exhausted to an exhaust tray 19 outside the electrophotographic apparatus, thus completing the copying operation. Meanwhile, a developer which is not associated with the developing operation and which is left on the photosensitive body 8 is removed by a cleaner 21 after the photosensitive body is first discharged by a discharger lamp 20. Thereafter, the photosensitive body 8 is ready for the next copying cycle. According to the electrophotographic apparatus described above, an output from an external output device such as a computer and a word-processor can be connected to an input section 22 of the apparatus. Therefore, the apparatus can also be used as a multicolor printer for printing a multicolor image in accordance with color signals.

The present inventors have examined the conventional electrophotographic apparatus described above from various points of view and found the following problems.

The photosensitive body 8 charged by the charger 7 must maintain its charge thereon until it passes the third developing unit 14. However, in practice, the photosensitive body 8 can hardly comprise a photosensitive material which is uniformly charged for such a long period of time. Even if the photosensitive body 8 can comprise such a photosensitive material (e.g., pure selenium), the photosensitive material has a poor photosensitive property and has a spectral sensitivity restriction. Furthermore, even if the material has no restriction regarding spectral sensitivity, image quality is greatly degraded due to charge attenuation. In order to prevent such degradation of image quality, it is proposed that rechargers 23-*a* and 23-*b* for recharging the photosensitive body 8 prior to exposure for individual color components are arranged in front of the second and third developing units 13 and 14 so as to compensate a charge attenuation ΔV from the photosensitive body 8. The necessary, stable potential for development is thus guaranteed by the rechargers 23-*a* and 23-*b*.

In this case, however, a potential distribution of the photosensitive body 8 is illustrated in FIG. 2 wherein the potential VR1 of a portion E exposed by the exposure beam 9*a* and the potential V1 of a nonexposed portion, as indicated by broken lines, respectively, in FIG. 2, change to potentials VR2 and V2, as indicated by solid lines, respectively, after recharging is performed. In this case, the already developed portion E must not be applied with the developer when the second and subsequent color reverse development cycles are performed. For this purpose, the electrostatic contrast value (VB−VR2) for development must be smaller than the developing sensitivity of the developer. However, in practice, the potential of the portion which is once exposed cannot be restored to the original potential, that is, the potential of the portion which is not exposed, even when the initial potential V1 of the photosensitive body 8 is kept constant. For this reason, the portion developed by the first developing unit 12 is developed again by the developing units 13 and 14, thus resulting in overlapping of colors. As a result, a desired color cannot be obtained.

This problem is based on the fact that satisfactory results can be obtained only when the photosensitive body 8 is entirely discharged and charged again. Therefore, latent image discharge light source must be arranged in addition to the rechargers 23-*a* and 23-*b* and an apparatus cannot be made compact as a whole. Repeated exposure of the photosensitive body 8 in the vicinity of the rechargers 23-*a* and 23-*b* is not preferred because it leads to fatigue of the photosensitive body 8. The present inventors have found that a fatigue phenomenon of a highly sensitive photosensitive body which comprises a selenium-tellurium alloy photosensitive material or an amorphous silicon photosensitive material was accelerated when the photosensitive body was repeatedly exposed.

SUMMARY OF THE INVENTION

The present invention is an electrophotographic method and apparatus for forming a clear color image without undesirable color mixing caused by color interference.

A color image is formed electrophotographically on an image carrier by repeating a cycle of charging, exposure and development a plurality of times. A first charging process charges an image carrier, and a first exposure process exposes the image carrier charged by said first charging process and forms on the image carrier a first latent image corresponding to a first image. A first developing process supplies a first developer to the first latent image and forms a first visible image on the image carrier. A second charging process charges the image carrier having the formed visible image thereon. A second exposure process for exposes the image carrier charged by said second charging process and forms a second latent image corresponding to a second image thereon. A second developing process supplies a second developer to the second latent image and forms a second visible image on said image carrier. The first and second visible images formed on the image carrier are then transferred onto a sheet.

The second charging process charges the image carrier by applying to a corona charger an AC voltage deviated by a predetermined level toward a charging polarity of the image carrier.

Also in accordance with the present invention an electrophotographic apparatus forms first and second latent images on an image carrier, which is moved along one direction. A first charging device charges the image carrier and a first exposing device exposes the image carrier so charged by the first charging device and forms a first latent image corresponding to a first image on the image carrier. A first developing device supplies a first developer to the first latent image and forms a first visible image on said image carrier; second charging device charges the image carrier having the first visible image thereon. A second exposing device exposes the image carrier charged by the second charging device and forms a second latent image corresponding to a second image thereon. A second devloping device supplies a second developer to the second latent image and forms a second visible image on said image carrier. A transferring device transfers the first and second visible images to a sheet.

The second discharging device includes a first corona charger for discharging corona to charge the image carrier upon application of a voltage thereto, and a first voltage applying circuit, connected to the first corona charger, for applying to said first corona charger an AC voltage shifted by a predtermined level toward a charging polarity of the image carrier.

DETAILED DESCRIPTION OF THE PREFERRED EMBODIMENT

One embodiment of an electrophotographic method and apparatus according to the present invention will be described in detail with reference to FIGS. 3 to 13.

Figure 1:
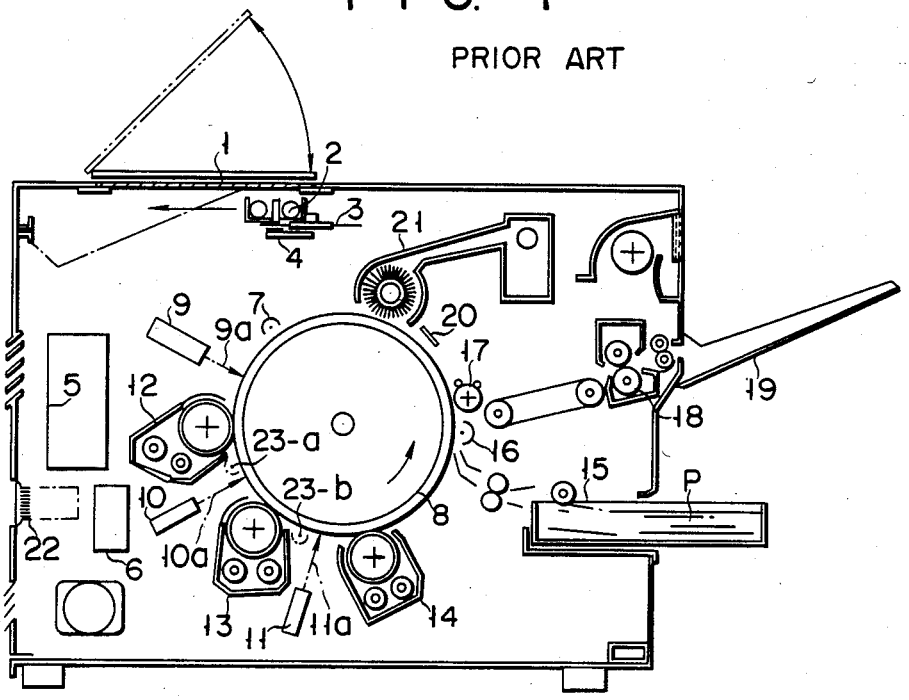
FIG. 1 PRIOR ART
FIG. 1 is a side view schematically showing a conventional multicolor copying apparatus.
Figure 2:
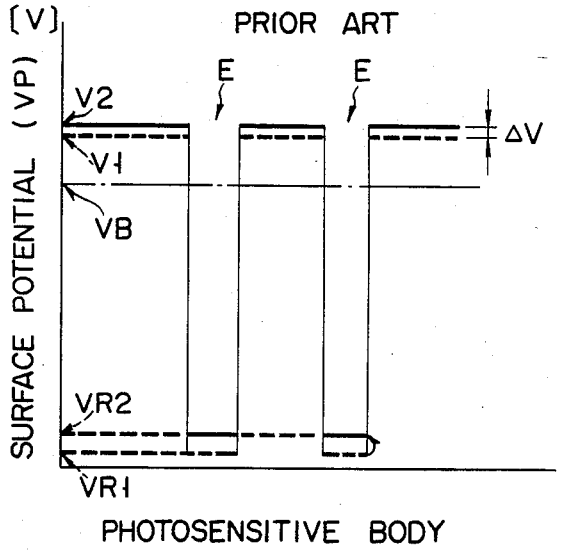
FIG. 2 PRIOR ART
FIG. 2 is a graph showing the distribution of the surface potential of a photosensitive body so as to explain the conventional problems.
Figure 3:
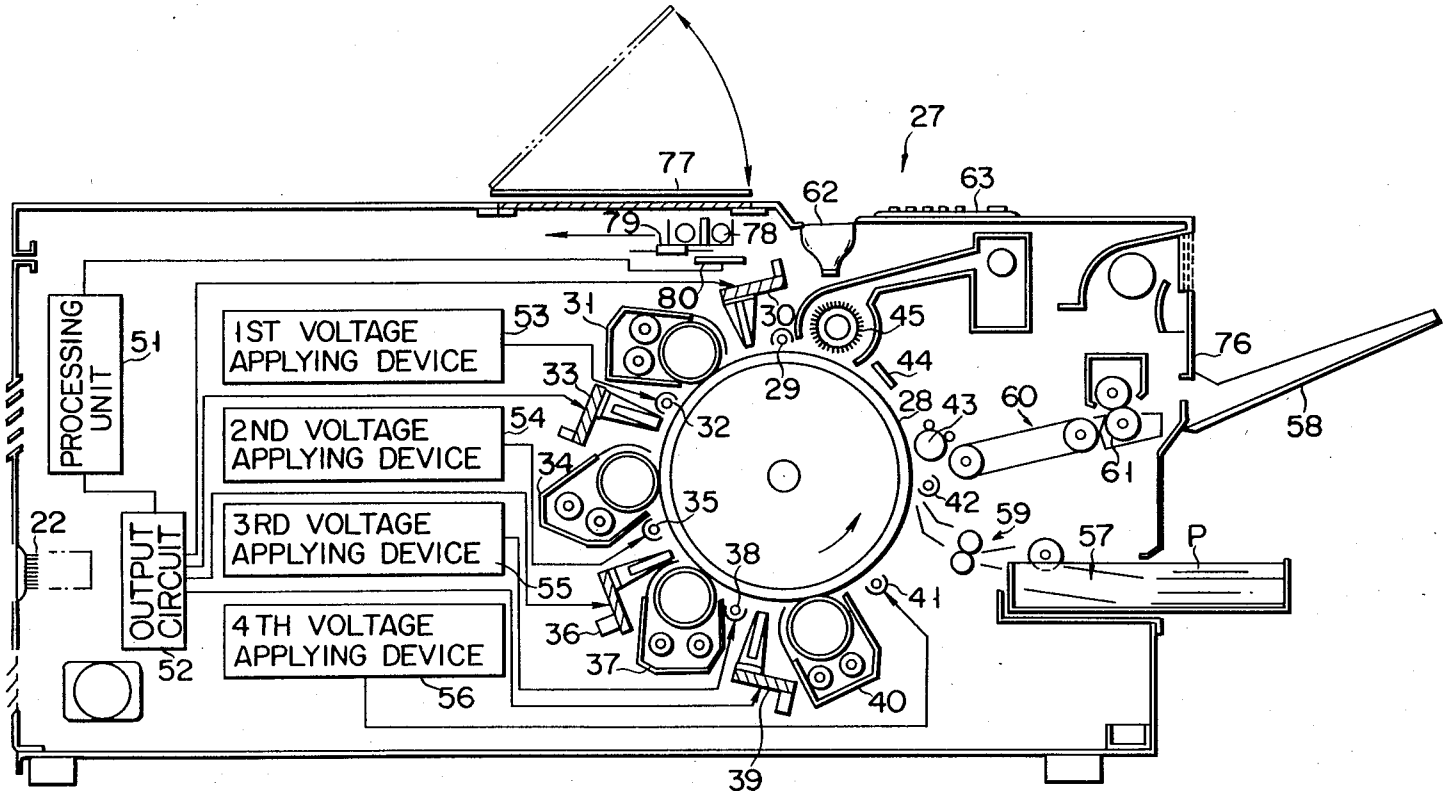
FIG. 3 is a side view schematically showing an electrophotographic apparatus of an embodiment according to the present invention.

As shown in FIG. 3, an electrophotographic apparatus 27 of this one embodiment has a photosensitive body or drum 28 as an image carrier, which rotates counterclockwise. A charger 29, a first scanning unit 30, a first developing unit 31, a first recharger 32, a second scanning unit 33, a second developing unit 34, a second recharger 35, a third scanning unit 36, a third developing unit 37, a third recharger 38, a fourth scanning unit 39, and a fourth developing unit 40 are disposed around the photosensitive body 28 along the direction of rotation thereof so as to form a color image on the photosensitive body 28.

The first scanning unit 30 serves to form a latent image corresponding to a black component of an image on the photosensitive body 28. The first developing unit 31 is disposed to supply a black developer to the photosensitive body 28. The second scanning unit 33 serves to form a latent image corresponding to a red component of the image on the photosensitive body 28. The second developing unit 34 is disposed to supply a red developer to the photosensitive body 28. The third scanning unit 36 serves to form a latent image corresponding to a blue component of the image on the photosensitive body 28. The third developing unit 37 is disposed to supply a blue developer to the photosensitive body 28. The fourth scanning unit 39 serves to form a latent image corresponding to a yellow component of the image on the photosensitive body 28. The fourth developing unit 40 is disposed to supply a yellow developer to the photosensitive body 28.

A control charger 41, a transfer corona charger 42, a separating unit 43, a discharger lamp 44 and a cleaner 45 are disposed downstream of the fourth developing unit 40 (i.e., between the fourth developing unit 40 and the charger 29) along the direction of rotation of the photosensitive body 28, so as to perform image transfer from the photosensitive body 28 to the paper sheet P and cleaning of the photosensitive body 28 after the transfer operation.

Figure 4:
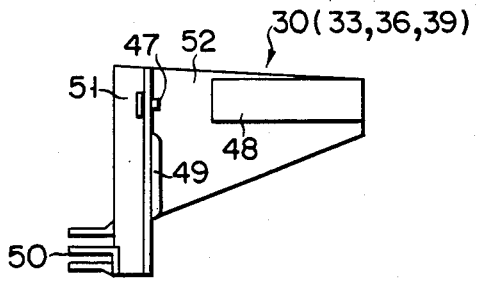
FIGS. 4 and 5 are respectively a side view and a perspective view of an optical scanning unit.
Figure 5:
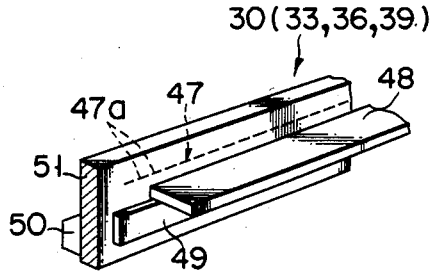

Each of the first to fourth scanning units 30, 33, 36 and 39 is arranged such that an array 47 (to be called an LED array hereinafter) of 16 light-emitting diodes 47*a* per 1 mm is coupled to a rod array lens ("Selfoc" lens) 48. The LED array 47 is mounted on a ceramic base 51 together with a driver IC 49 and pins 50. The converging photoconductive member 48 is mounted on the ceramic base 51 through a pair of holders 52 (only one holder is illustrated), as shown in FIGS. 4 and 5.

The first to fourth developing units 31, 34, 37 and 40 comprise known magnetic brush developing units, respectively.

An original table 77 is disposed on the upper surface of a housing 76 of the electrophotographic apparatus 27. A known exposure optical system 78 is reciprocally disposed below the original table 77 in the housing 46 so as to expose the original. A known tricolor separation filter 79 is mounted in the exposure optical system 78 to receive light reflected by the original and separate the reflected light into three color components. An image reading element 80 is disposed adjacent to the tricolor separation filter 79. The separated light beams from the tricolor separation filter 79 are incident on the image reading element 80 and are converted to electrical signals respectively corresponding to the three color components.

A processing unit 51 is arranged in the housing 76 and is connected to the image reading element 80. The processing unit 51 stores the electrical signals from the image reading element 80 and processes them. An output circuit 52 is connected to the processing unit 51 to generate drive signals for driving the first to fourth scanning units 30, 33, 36 and 39 in accordance with the control signals generated therein. First to fourth voltage applying devices 53, 54, 55 and 56 are respectively connected to the rechargers 32, 35 and 38 and the control charger 41 so as to supply predetermined voltages to the rechargers 32, 35 and 38 and the control charger 41, as will be described later.

A cassette 57 is detachably mounted on one side surface of the housing 76 and stores a plurality of recording paper sheets P. An exhaust tray 58 which receives the copied sheets P is disposed at the housing side surface above the cassette 57. A first conveyor mechanism 59 is disposed in a space between the transfer section (a space defined between the transfer corona charger 42 and the photoconductive body 28) and the cassette 57 so as to convey the paper sheet P to the transfer section. This space is also defined by the transfer corona charger 42 and the photosensitive body 28. A second conveyor mechanism 60 is disposed between the transfer section and the first conveyor mechanism 59 so as to convey to the exhaust tray 58 the copied sheet P separated by the separating unit 43 from the photosensitive body 28. A fixing unit 61 is disposed in the second conveyor mechanism 60 to fix the toner image on the sheet P.

Reference numeral 62 denotes a display unit; and 63, a control panel for image processing.

Figure 6:
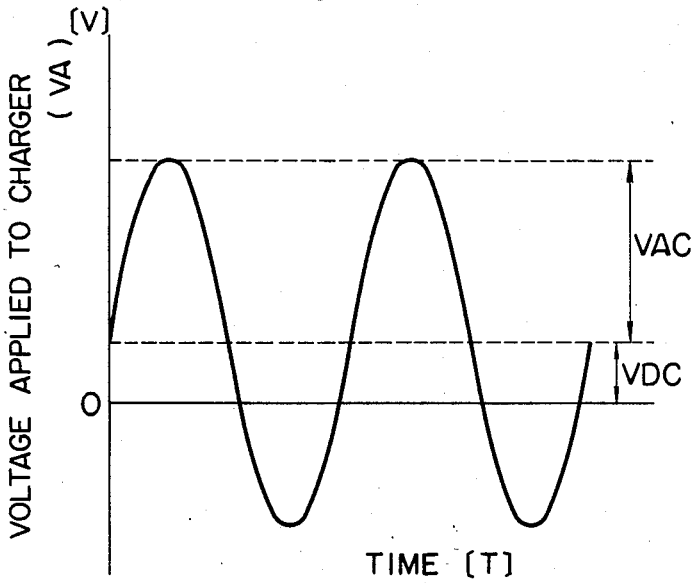
FIG. 6 is a diagram showing a waveform of a voltage applied to rechargers.

In order to prevent undesirable color mixing as one of the conventional problems, there are two conditions which must be simultaneously satisfied. First, a charge potential VP of the photosensitive body 28 must be kept constant. Second, the value obtained by subtracting a potential VR1 of an exposed portion from a developing bias potential VB, that is, the value (VB−VR1), must be smaller than that of the development start potential. Various experiments have been conducted. It was found that a voltage VA applied to the rechargers 32, 35 and 38 must consist of an AC component VAC and a DC component VDC, as shown in FIG. 6. Therefore, when the rechargers 32, 35 and 38 comprised rechargers of the AC-DC superposition type, it was found that the above two conditions were simultaneously satisfied.

Figure 7:
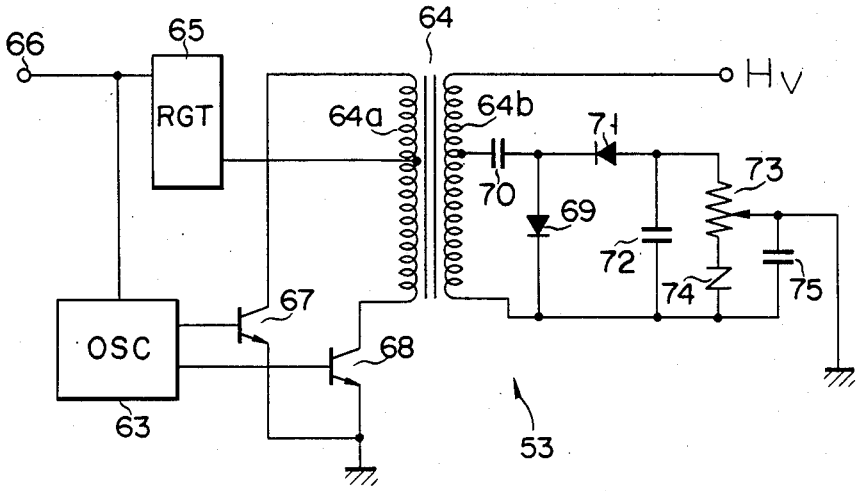
FIG. 7 is a circuit diagram of a voltage applying device for generating the voltage having the waveform shown in FIG. 6.

The voltage VA consisting of the AC component VAC (400 Hz) and the DC component VDC can be generated from the first to third voltage applying devices 53, 54 and 55 as shown in FIG. 7.

The first to third voltage applying devices 53, 54 and 55 have an identical arrangement, so that only the first voltage applying device 53 is exemplified. The voltage applying device 53 comprises a boosting transformer 64 and an oscillator (OSC) 63 for oscillating first and second output signals whose phases are 180 degrees apart from each other. Each output signal from the OSC 63 has a frequency of 400 Hz. The boosting transformer 64 has a primary coil 64*a* and a secondary coil 64*b*. The output terminal of an input control section (RGT) 65 is connected to the central tap of the primary coil 64*a*. The input terminals of the OSC 81 and the RGT 65 are commonly connected to a power supply terminal 66 of 24 V. A first transistor 67 is connected between one end of the primary coil 64*a* and ground, and its conduction state is controlled by the first output signal generated from the OSC 63. A second transistor 68 is connected between the other end of the primary coil 64*a* and ground, and its conduction state is controlled by the second output signal generated from the OSC 81.

A first capacitor 70 is arranged such that one end thereof is connected to the central tap of the secondary coil 64*b* and the other end thereof is connected to the other end of the secondary coil 64*b* through a first diode 69. Furthermore, a second capacitor 72 is arranged such that one end thereof is connected to the other end of the secondary coil 64*b* and the other end thereof is connected to the other end of the first capacitor 70 through a second diode 71. The first and second diodes 69 and 71 and the first and second capacitors 70 and 72 constitute a doubler rectifier.

A series circuit of a variable resistor 73 and a varistor 74 is connected between the two ends of the second capacitor 72. A slider of the variable resistor 73 is connected to the other end of the secondary coil 64*b* through a third capacitor 75 and is directly grounded. The variable resistor 73 serves as a DC control element. The first voltage applying device 53 has the configuration described above, so that a voltage consisting of an AC component and a DC component superposed thereon appears at an output terminal Hv, as shown in FIG. 6.

An experiment was conducted wherein the DC and AC components were combined within the range between 0 and 6.5 kilovolts by controlling the RGT 65 and the variable resistor 73. The surface potential V1 of the nonexposed portion and the surface potential VR1 of the exposed portion after these portions of the photosensitive body 28 had passed by the first developing unit 34, and the potential V2 of the nonexposed portion and the potential VR2 of the exposed portion after these portions had passed by the first recharger 32 were examined.

Figure 8:
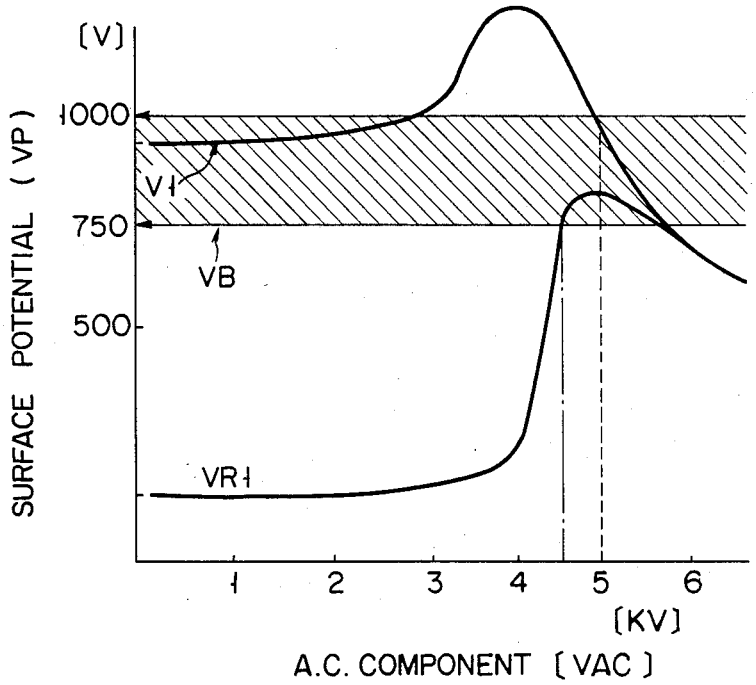
FIG. 8 is a graph showing a change in surface potential of a photosensitive body when a DC component of a recharger is fixed and an AC component thereof varies.
Figure 9:
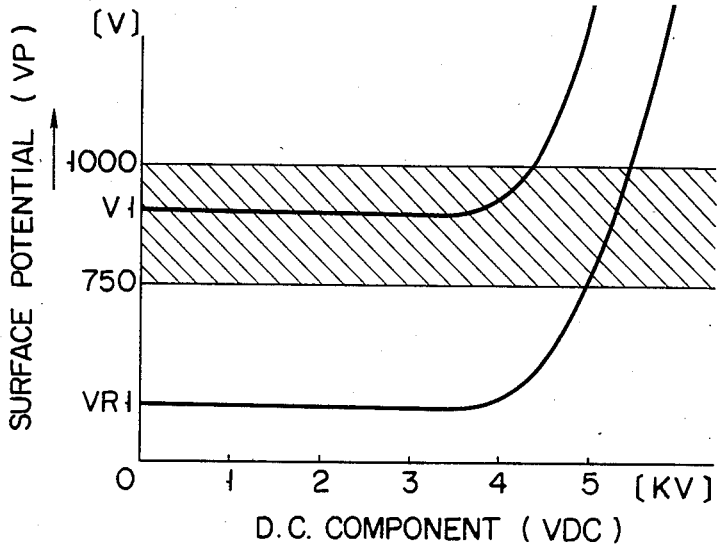
FIG. 9 is a graph showing a change in surface potential of a photosensitive body when a voltage applied to a recharger has only a DC component and the DC component changes.
Figure 10:
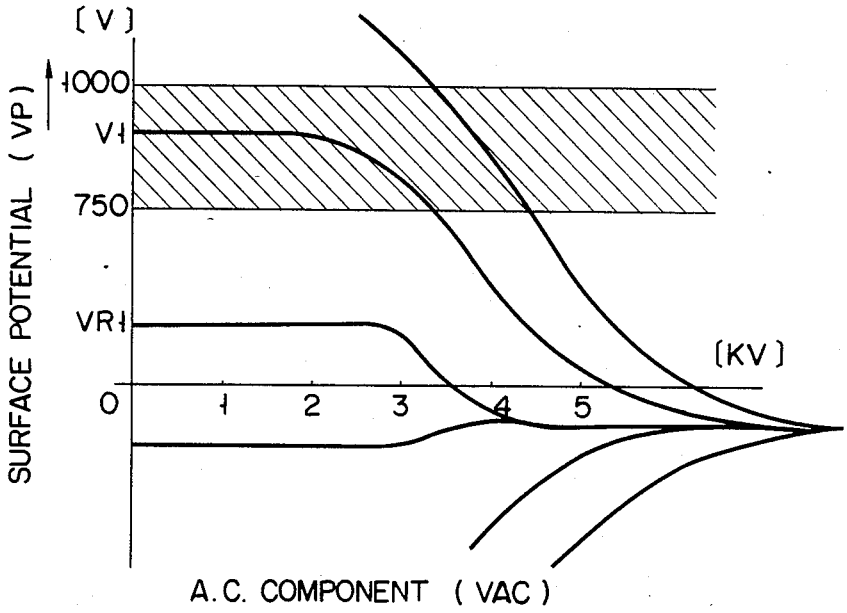
FIG. 10 is a graph showing a change in surface potential of a photosensitive body when a voltage applied to a recharger has only an AC component and the AC component changes.

It was then found that the AC component VAC had to fall within the range between 4.6 and 5.2 kilovolts, preferably, be a voltage of 5.0 kilovolts when the DC component VDC was set at a voltage of 1.0 kV so as to obtain the hatched region in FIG. 8 (between the voltage of 1,000 V required for the nonexposed portion and a development start voltage of 750 V of the portion to be exposed in the electrophotographic apparatus of this embodiment). FIG. 8 shows a change in surface potential of the photosensitive body 28 when the DC component is set at a voltage of 1.0 kV and the AC component varies. FIG. 9 shows a case wherein the AC component is not included and only the DC component is used. FIG. 10 shows a case wherein the DC component is not included and only the AC component is used. The cases in FIGS. 9 and 10 cannot satisfy the conditions described above.

Figure 11:
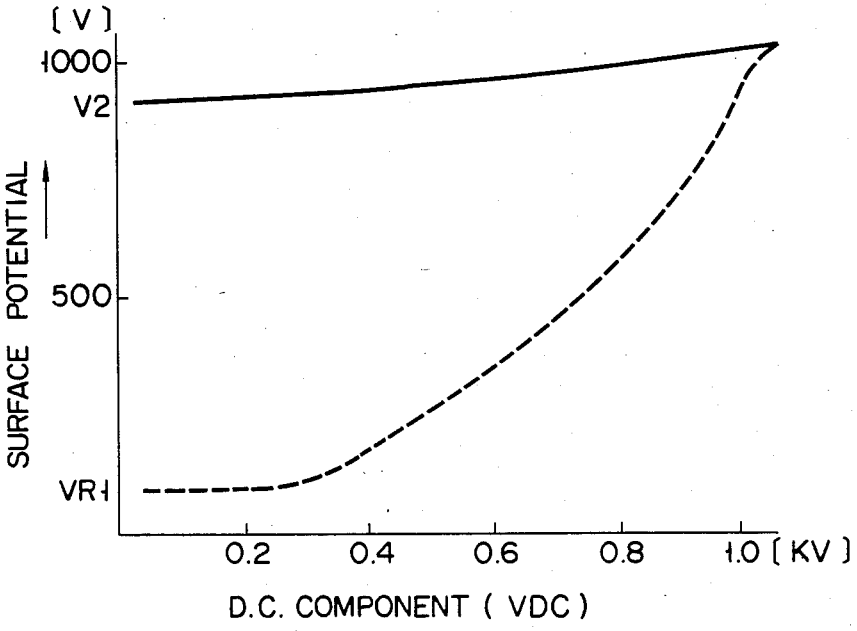
FIG. 11 is a graph showing changes in surface potentials of exposed and nonexposed portions after recharging when a recharger of an AC-DC superposition type is used and the DC component changes.
Figure 12:
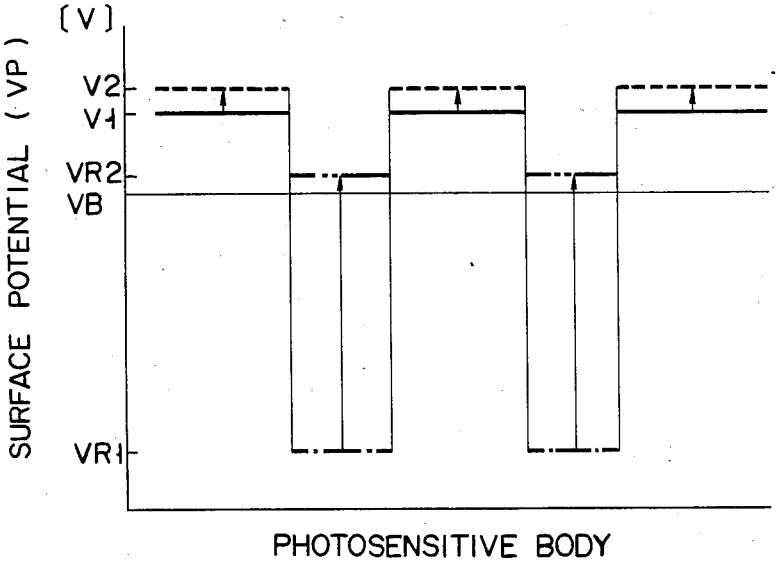
FIG. 12 is a graph showing surface potentials of exposed and nonexposed portions both prior to and after recharging when a recharger of an AC-DC superposition type is used.

In the above experiment, the photosensitive body including a photosensitive layer which is made of selenium-tellurium material and has a thickness of 60 microns was driven at a rotation speed of 130 mm/sec. The frequency of the AC component must be determined so as not to generate an unevenness of surface potential corresponding to the frequency of AC. Furthermore, a change in surface potential VR2 of the exposed portion after recharging and a change in surface potential V2 of the nonexposed portion after recharging are shown in FIGS. 11 and 12 using DC component as a parameter. In this case, the AC component is fixed at a voltage of 5 kV. Referring to FIG. 11, the solid curve indicates the surface potential of the nonexposed portion after recharging, and the dotted curve indicates the surface potential of the exposed portion after recharging. Referring to FIG. 12, the thick solid line indicates the surface potential of the nonexposed portion prior to recharging, the broken line indicates the surface potential of the nonexposed portion after recharging, the one-dot and dashed line indicates the surface potential of the exposed portion prior to recharging, and the two-dots and dashed line indicates the surface potential of the exposed portion after recharging, all of which are considered along the circumferential direction of the surface of the photosensitive body. FIGS. 11 and 12 indicate that the surface potential of the photosensitive body 28 can be controlled by changing the DC component VDC.

The effect of converging the surface potential of photosensitive body is achieved by AC corona discharge and adding DC component to AC corona discharge the result is that converging potential is shifted corresponding to the DC component, so only the exposed portion of the photosensitive body 28 could be selectively charged. No adverse effect which would disturb the nonfixed image can result from the above discharging conditions.

The fourth voltage applying device 56 is connected to the control charger 41 to apply a voltage thereto. The fourth voltage applying device 56 has the same arrangement as that of the first to third voltage applying devices 53, 54 and 55.

The operation of the electrophotographic apparatus 27 having the construction described above will now be described.

A DC positive voltage of 5.6 kV is applied by the charger 29 to the photosensitive body 28, so that the photosensitive body 28 is charged with a surface potential of 1,000 V (V1 = 1,000 V). The surface of the photosensitive body 28 is scanned with the first scanning unit 30 in accordance with the image optical signal which corresponds to the black image component and which is supplied from the image reading element 50 or the input section 22 to the first scanning unit 30. A latent image of the black image component is formed on the photosensitive body 28. First development is performed by the first developing unit 31 using the black developer (black toner). A voltage consisting of a DC component VDC of 1.0 kV and an AC component VAC of 5.0 kV is applied from the first voltage applying device 53 to the first recharger 32. The photosensitive body 28 is then scanned with the second scanning unit 33 in accordance with the image optical signal corresponding to the red image component, thereby forming a latent image corresponding to the red image component. This latent image is developed by the second developing unit 34 using the red developer (red toner). In the same manner as described above, the second and third rechargers have the same voltage applied thereto, and the third developing unit 37 using the blue developer (blue toner)

and the fourth developing unit 40 using the yellow developer (yellow toner) are sequentially operated.

The four-color toner image formed on the photosensitive body 28 passes by the control charger 41 which controls the amount of charge of toner and which has a voltage applied thereto. This voltage consists of the AC component VAC of 5.0 kV and the DC component VDC of 1.5 kV and is applied from the fourth voltage applying device 56 to the control charger 41. The toner image on the photosensitive body 28 is then transferred to the paper sheet P supplied from the cassette 57 since a voltage of −5.5 kV is applied to the transfer negative corona charger 42. The sheet P having the toner image thereon is separated by the separating unit 43 from the photosensitive body 28 and is fixed by the fixing unit 61. The fixed copied sheet P is then exhausted into the exhaust tray 58.

The color copy obtained by the color recording process under the above conditions is free of color mixing. Furthermore, by the effect of the control charger 41 operated in the same manner as the rechargers 32, 35 and 38, the toner charge amounts of individual colors can be uniformly controlled. So transfer corona discharge is performed to obtain good transfer efficiency. As a result, a four-color copy having a good tranferred state can be obtained.

Figure 13:
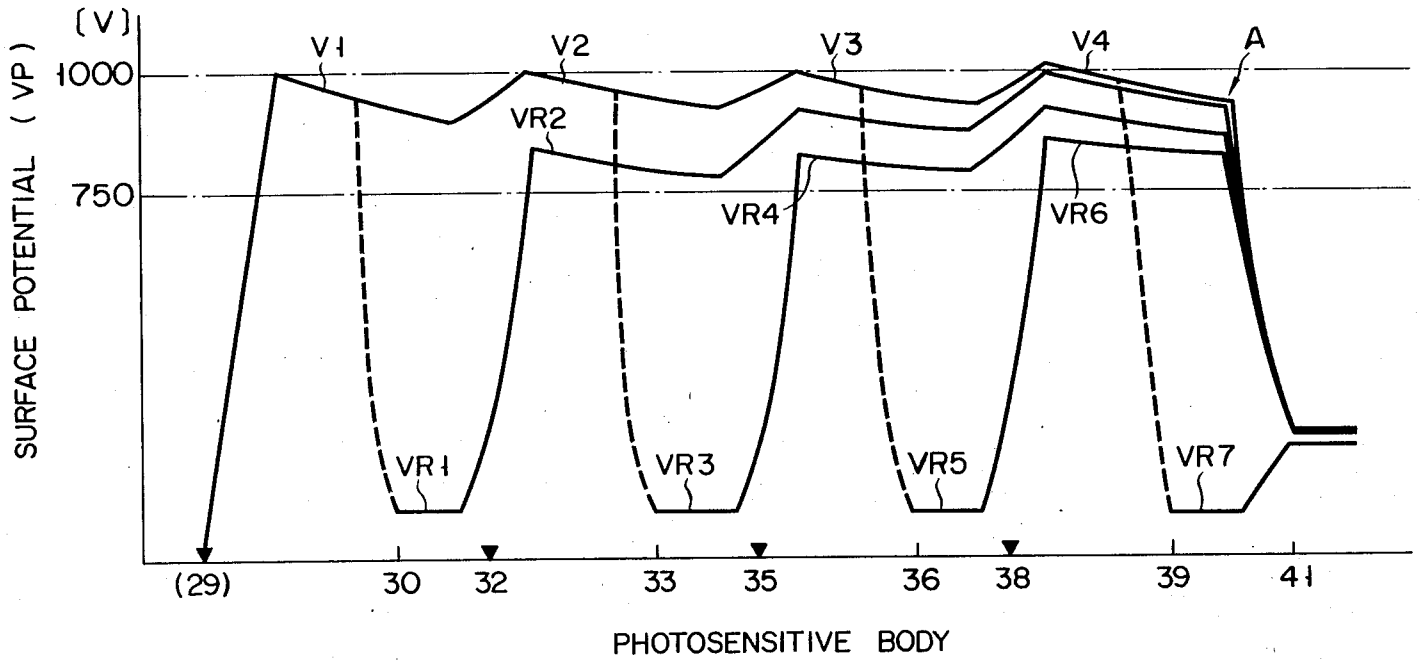
FIG. 13 is a graph showing the surface potential distribution at various positions on a photosensitive body.

FIG. 13 is a graph of surface potentials at an individual position of the photosensitive body 28. The numeric values plotted along the axis of abscissa indicate reference numerals of the components (units) shown in FIG. 3. The potentials VR1, VR3 and VR5 of a position which are obtained by exposing a portion corresponding to this position by the first to fourth scanning units 30, 33, 36 and 39 are recharged to be higher than the voltage of 750 V which does not allow charging by the rechargers 32, 35 and 38. The potentials V1 to V3 of the nonexposed portions are increased by the rechargers 32, 35 and 38 by amounts corresponding to natural discharge (dark attenuation) of the photosensitive body 28, so that the nonexposed portions can be kept at the voltage of 1,000 V throughout the whole process.

The potentials of the exposed portions which are developed by the four corresponding color toners (i.e., the potentials of the toner portions of the photosensitive body 28) vary as indicated by arrow A in accordance with the corresponding color toners. Therefore, uniform conditions cannot be provided in the next transfer process. In other words, the first developer (black toner) is influenced by charge caused by the corona discharge at the time of recharging. For this reason, the first color toner has a potential greatly different from that of the fourth color toner (yellow toner). In this state, good transfer efficiency cannot be obtained with respect to the individual toners under operation of the corona charger 42. As a result, part of the image cannot be transferred, resulting in a significant problem.

However, according to the embodiment of the present invention, since the voltage is applied to the control charger 41 as described above, the surface potentials of the individual color toners can be a uniform voltage of about 200 V which is suitable for the transfer operation, thereby improving the transfer efficiency.

The embodiment of the present invention has been described under fixed optimum conditions. However, as previously described, a desired potential of the photosensitive body can be obtained by the rotation speed of the photosensitive body and a combination of the DC and AC components of the dischargers. The recharging potentials can be arbitrarily controlled in accordance with the development method. Unlike the conventional method, high-quality color recording can be performed.

According to the electrophotographic apparatus of the present invention, the image can be temporarily stored, and can be edited at the control panel 63 while observing the image on the display unit 62. Furthermore, color conversion can also be performed. In this manner, a processed color image can be reproduced, so that a multifunctional, highly reliable recording apparatus can be provided.

The individual toner images formed on the photosensitive body 28 may fall outside the range of possible transfer conditions of the corona or roller transfer operation since the amounts of charge by the corona discharger differ from each other, as indicated by the arrow A in FIG. 13. In particular, once the toner is suffered by corona charge, the attracting force acting on the toner particles is increased, so that the toner particles tend to be attracted to the photosensitive body. For example, the first toner image tends not to be transferred as compared with the fourth toner image. Therefore, in order to transfer the toner image having different charging conditions under the uniform transfer condition, the toner must be charged with a voltage having a polarity opposite to that of the toner so as to equalize the amounts of charge of the individual toners as far as possible. The AC component VAC of the control charger 41 is used to equalize the charges of the plurality of toners, and the DC component VDC thereof is used to control the amounts of charge, the polarity and the transfer conditions.

The present invention is not limited to the particular embodiment described above. In the above embodiment, the reverse developing method is used wherein the developer or toner is deposited on a latent image. However, as is apparent from the above description, the same effect can be obtained utilizing the normal development method. The present invention can also apply to the normal development method in accordance with similar procedures to those described above. In this sense, the present invention is not limited to the reverse development method. In the above embodiment, four-color reproduction is performed upon one revolution of the photosensitive body. However, an image can be formed by a plurality of revolutions of the photosensitive body under the condition that the cleaning is not operated. In this case, it will be readily understood that the voltage is applied to the recharger prior to the developing cycle by the individual color toners so that the same effect as in the above embodiment can be obtained. In this case, the transfer corona charger 42 and the control charger 41 are operated after the final development is completed. Furthermore, in the above embodiment, color image recording is exemplified. However, the present invention is not limited to these explanation. Various other changes and modifications may be made within the spirit and scope of the present invention.

What is claimed is:

1. An electrophotographic method comprising the steps of:

(1) charging an image carrier to above a predetermined threshold potential;

(2) exposing portions of said image carrier charged by said charging step (1) to energy representing a first image to form thereon a first latent image corresponding to said first image while maintaining the remainder of said image carrier above said predetermined threshold potential;

(3) supplying a first developer to the first latent image formed by said exposing step (2) to form a first visible image on said image carrier while maintaining the remainder of said image carrier above said threshold potential;

(4) charging, in a single step, said image carrier after the first visible image is formed thereon by the supplying step (3) to above said threshold potential;

(5) exposing portions of said image carrier charged by said charging step (4) to energy representing a second image to form thereon a second latent image corresponding to said second image while maintaining the remainder of said image carrier above said predetermined threshold potential;

(6) supplying a second developer to the second latent image formed by the exposing step (5) to form a second visible image on said image carrier while maintaining the remainder of said image carrier above said predetermined threshold potential; and (7) transferring the first and second visible images formed on said image carrier onto a sheet, wherein said charging step (4) includes the step of charging said image carrier such that the surface potential of a portion of said image carrier exposed by said exposing step (2) is substantially the same as that of a nonexposed portion thereof, and the potential of each portion of said image carrier, except between exposure of that portion and subsequent charging, is maintained above a predetermined threshold potential.

2. The method according to claim 1 wherein the charging step (4) includes the step of controlling the surface potential of surfaces of the image carrier not exposed by the exposing step (2) to not increase compared with the surface potential of said image carrier existing prior to the charging step (4).

3. The method according to claim 2, wherein the first image has a predetermined color and the first developer supplied by the supplying step (3) has the same color as the first image, and the second image has a color different from that of the first image and the second developer supplied by the supplying step (6) has the same color as the second image.

4. The method according to claim 1 further comprising the steps, performed after the supplying step (6) and before the tranferring step (7), of (a) applying an AC voltage shifted by a predetermined level toward a polarity opposite to that of a voltage applied to a transfer charger and (b) charging the first and second visible images on said image carrier prior to image transfer by said transferring step (7).

5. The method according to claim 4, wherein the charging step (b) includes the step of charging the first and second visible images such that the potential of the first visible image becomes substantially equal to that of the second visible image.

6. The electrophotographic method according to claim 1, wherein said charging step (4) charges the image carrier such that the surface potential of the portion of said carrier exposed by the exposing step (2) has such a potential level as not to be supplied with said second developer by said supplying step (6).

7. The electrophotographic method according to claim 6, wherein the surface potential level of the surfaces of the image carrier exposed by said exposing step (5) falls within a prescribed range.

8. The electrophotographic method according to claim 7, wherein the charging step (4) charges the image carrier such that the surface potential of the surfaces of the image carrier not exposed by said exposing step (2) is set to fall within the prescribed range.

9. An electrophotographic apparatus comprising:

an image carrier, moveable in a first direction, on which first and second latent images are formed;

first charging means for charging siad image carrier above a predetermined threshold potential;

first exposing means for exposing said image carrier charged by said first charging means and forming a first latent image thereon corresponding to a first image;

first developing means for supplying a first developer to the first latent image to form a visible image on said image carrier;

second charging means for charging said image carrier having the first visible image thereon above said predetermined threshold potential;

second exposing means fdr exposing said image carrier charged by said second charging means to form a second latent image corresponding to a second image thereon;

second developing means for supplying a second developer to the second latent image and forming a second visible image on said image carrier, and transferring means for transferring the first and second visible images to a sheet, wherein said second charging means includes:

first corona charging means for discharging corona to charge said image carrier in response to a first voltage applied thereto, and first voltage applying means, connected to said first corona charging means, for producing said first voltage and applying said first voltage to said first corona charging means, said first voltage having an AC component shifted by a predetermined level toward a charging polarity of said image carrier such that the surface potential of a portion of said image carrier exposed by said first exposing means becomes substantially equal to that of a nonexposed portion thereon; said image carrier cooperating with all of said means to maintain the potential of each portion of said image carrier except between exposure of that portion and subsequent charging, above said predetermined threshold potential.

10. The electrophotographic apparatus according to claim 9, wherein said first voltage applying means applies a voltage to enable the first corona charging means to charge the image carrier such that the surface potential of the portion of the image carrier which is exposed by the first exposing means has such a level as not to be developed by the second developing means.

11. The electrophotographic apparatus according to claim 10, wherein the surface potential level of exposed portions of the image carrier falls within a prescribed range.

12. The electrophotographic apparatus according to claim 11, wherein the voltage applied by the first voltage applying means to the first corona charging means enables the first corona charging means to charge the image carrier such that the surface potential of the portion of the image carrier which is not exposed by the first exposing means has such a level as to fall within said prescribed range during developing by the second developing means.

13. The apparatus according to claim 9, wherein the first image has a predetermined color and the first developer has the same color as the first image, and the second image has a color different from that of the first image and the second developer has the same color as the second image.

14. The apparatus according to claim 9, which further comprising third charging means, arranged between said second developing means and said transferring means, for charging the first and second visible images such that a potential of the first visible image becomes substantially equal to that of the second visible image.

15. The apparatus according to claim 4, wherein said third charging means includes:

second corona charger means for discharging corona and changing the potentials of the first and second visible images upon application of a voltage thereto; and second voltage applying means, connected to said second corona charger, for applying to said second corona charger the AC voltage shifted by the predetermined level toward the polarity opposite to that of a voltage applied to said transferring means.

* * * * *